United States Patent [19]

Harvey et al.

[11] 4,389,189

[45] Jun. 21, 1983

[54] REFRACTORY COMPONENTS FOR FURNACES

[75] Inventors: Barrie J. Harvey, Tyldsley; Robert C. Willson, Addlestone, both of England

[73] Assignee: M. H. Detrick Co., Ltd., London, England

[21] Appl. No.: 288,201

[22] Filed: Jul. 29, 1981

[30] Foreign Application Priority Data

Jul. 29, 1980 [GB] United Kingdom ..... 8024816

[51] Int. Cl.[3] ..... F27D 1/00; F04B 5/04

[52] U.S. Cl. ..... 432/247; 52/600

[58] Field of Search ..... 432/247, 253; 110/338, 110/339, 340; 52/600, 601; 431/182, 188

[56] References Cited

U.S. PATENT DOCUMENTS

| | | | |
|---|---|---|---|
| 2,973,032 | 2/1961 | Reilly et al. | 431/188 |
| 3,872,636 | 3/1975 | Nicosia | 52/600 |
| 4,209,295 | 6/1980 | Frahme et al. | 432/247 |

FOREIGN PATENT DOCUMENTS

| | | | |
|---|---|---|---|
| 1316352 | 12/1962 | France | 110/340 |
| 1546540 | 5/1979 | United Kingdom | 432/247 |

*Primary Examiner*—John J. Camby

[57] ABSTRACT

A refractory component which is vacuum-formed from ceramic fibres and which is to be mounted on the external casing or frame structure of a furnace to form part of heat-resisting lining is provided with an internal reinforcement in those parts of the component nearest the casing or frame structure and by which the component is to be mounted on the casing or frame structure. The reinforcement is embedded in the component during formation thereof and is of stiff open mesh form extending in a plane parallel to the general plane of the part of the casing or frame structure on which the component is mounted. The reinforcement is made from heat-resisting metal alloy, refractory clay or recrystallized alumina and is preferably of channel-section or other three dimensional form to increase its stiffness.

13 Claims, 6 Drawing Figures

REFRACTORY COMPONENTS FOR FURNACES

Figure 1:
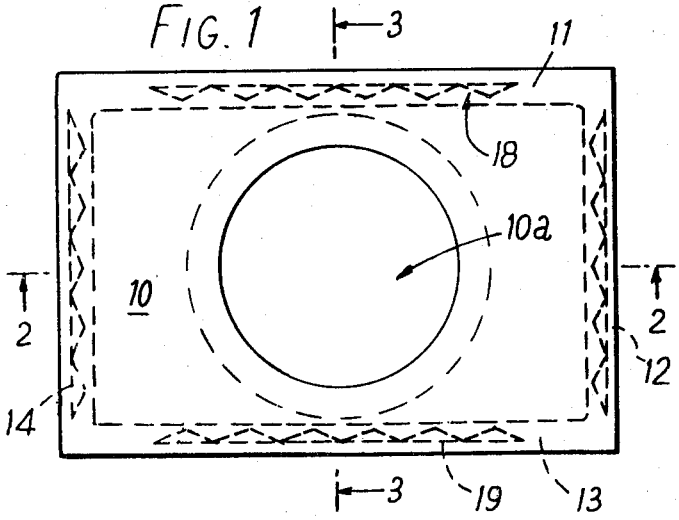

This invention relates to the reinforcement of refractory components which are vacuum formed from ceramic fibres and which are required to be mounted on the exterior structure of a furnace thus forming parts of the heat resisting refractory lining of the furnace. Such reinforced components may be, for example, modules, burner blocks, tube blocks, peep and access door frames and supports for electric heating elements.

According to this invention, there is provided a refractory component vacuum formed from ceramic fibre to be mounted on the exterior structure of the furnace (whether it be for example casings, columns or joists) wherein there is embedded during the vacuum forming process one or more reinforcing members of stiff open-mesh form disposed in that region of the component which will eventually be placed nearest to said structure and in a plane or planes generally parallel to the said structure and from which region the component is to be anchored to the structure, the reinforcing member being made of heat resisting metal alloy, refractory clay or re-crystallized alumina.

In practice the material from which the reinforcing member or members are formed depends upon the weight of the component, the temperature and chemistry of the furnace gases and the vibration encountered by the furnace in service.

Each of the said reinforcing members of open-mesh form, hereinafter called reinforcements, is preferably made of three-dimensional shape to add to the inherent resistance to bending of the material from which they are made, first, so that during forming of the component the reinforcements will not yield under vacuum and, in springing back when the vacuum ceases, distort the wet and soft component, and second, so that the reinforcements can transform the point loading of the anchors into a dispersed loading over the area of the component in which the reinforcements are embedded both by reason of the added strength acquired by shaping and by the multiplying of the planes in the fibre where shear is resisted. This may be accomplished by making the reinforcements of channel, trough, T or L section.

When such sections are employed and the component is mounted on the supporting structure, the reinforcement is best disposed so that one flange of the channel or the foot of the T or L section runs along the colder edge of the component parallel to that portion of the structure to which it is to be anchored. The web, in the case of a channel, is best disposed approximately centrally in the wall of the component so that the other flange is nearer the hot face of the furnace wall by the width of the web.

In reinforcements made of heat resisting metal alloys the mesh is diamond shaped, as commonly supplied in expanded metal. In reinforcements made from refractory the mesh may be oval or diamond shaped. These aperture shapes are much to be peferred because in them all of the strands of the mesh are load bearing in the sense that they resist loads tending to pull the mesh through the fabric of the fibre, whereas a square mesh cut parallel to the sides of the squares would be load bearing on only half its strands.

The size of the apertures and the coarseness of the strands are governed by the general length of the fibres being vacuum formed. The general fibre length is in turn determined by the size and delicacy of the component. Thin walls of smaller components can be advantageously formed of generally short fibres and these will form around and through smaller apertures. Larger components are of generally longer fibre lengths and require larger apertures if the fibre is to form without voids.

The length of the reinforcement extends along the wall of the component approaching the corners where the fabric is thicker and so stronger. However it is visualized that in certain applications the reinforcement may be bent in forming and take its position in a corner or corners of the component.

Applied to vacuum formed ceramic fibre burner blocks or fire face modules both of which are roughly five sided boxes with one open side (the colder side), four narrower sides the width of which constitutes a part of the thickness of the furnace wall, and the larger fifth side being the fire face, the invention provides the aforementioned reinforcement in one or more of the four narrower sides which are perpendicular, or nearly so to the fire face and in the positions described above.

Figure 2:
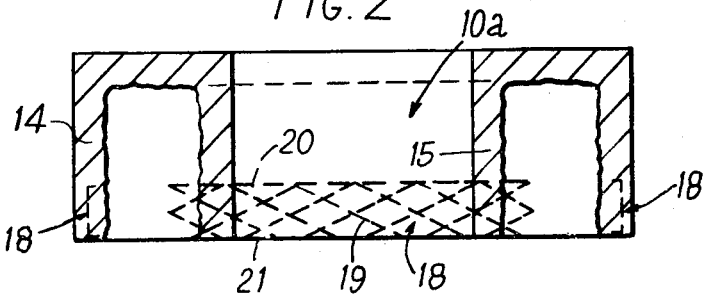
Figure 3:
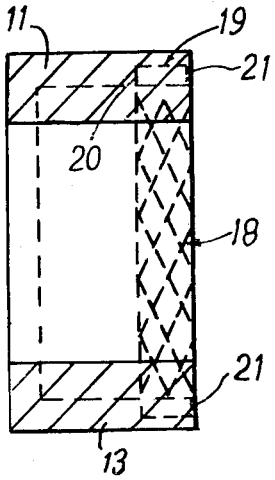
Figure 4:
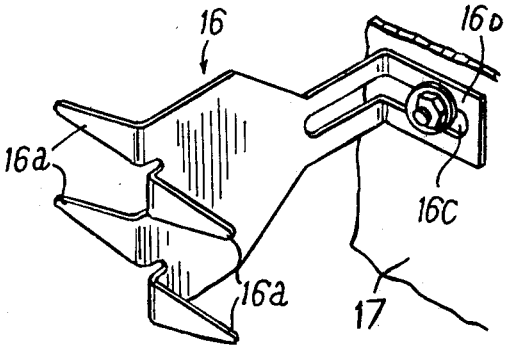

One embodiment of the invention will now be described by way of example with reference to the accompanying drawings in which:

FIG. 1 is a front view of a refractory burner block for use in a furnace, which block embodies the invention, FIG. 2 is a sectional view on the plane 2—2 of FIG. 1, FIG. 3 is a sectional end elevation on the plane 3—3 of FIG. 1, FIG. 4 illustrates a form of fastener or anchor and, FIGS. 5 and 6 show two alternative forms of reinforcement.

The drawings show a refractory burner block moulded in one piece from ceramic fibre by a vacuum forming technique which involves drawing into a mould cavity in the shape of the block, by means of powerful vacuum, a water slurry containing ceramic fibres of a required average length, bonding agents, organic or inorganic or both (starch and/or colloidal silica) and sometimes a quantity of filler such as tabular alumina the solid materials and a determinable amount of the bonding agents being retained. The solid material is retained in the mould cavity by filters forming part of the mould and the liquid being discharged from the cavity. The moulded block has a front wall 10 with a central aperture 10*a* and rearwardly extending side walls 11, 12, 13 and 14 and an inner side wall 15 about the aperture, which together form a box open at the rear. In use, the block is mounted by its side walls on the inner side of a steel furnace casing structure (not shown) in sealing side-wall to side-wall relationship with other furnace lining components in such a manner that the front wall 10 of the block define part of the furnace chamber. Additional refractory and/or heat-insulating material which may be desirable in order to increase the temperature gradient from the hot to the cold sides of the block may be placed in the two cavities enclosed by the side walls 11, 12, 13, 14 and side wall 15 and is held in place by an insulating back plate (not shown). The burner block is secured to the steel casing of the furnace by anchors 16, one of which is shown in FIG. 4, in the manner described in more detail in our Patent Specification No. 1544407, which extend inward between the side walls 12 of the two adjoining components and have oppositely directed teeth 16*a* which are pressed into the soft material of the two components. The rearward outer end portion 16*b* of the fastener is directed laterally and has a slot 16c in it which can be engaged by a stud welded to the casing 17 to enable the fastener to be secured to the casing. The outer end portion 16b may alternatively be welded to the casing 17. The inner ends of the fasteners are positioned sufficiently far outward from the hot front wall 10 not to be weakened to an unacceptable extent by the temperature to which they are exposed; the fasteners are protected by the body of ceramic fibre disposed between their teeth and the furnace chamber and by refractory sealing strips disposed between the side walls of the components and are cooled by conduction through the metal to the furnace casing structure.

In order to increase the secureness of its attachment to the casing structure the illustrated burner block has its four side walls 11 to 14 reinforced by having rigid refractory mesh embedded therein. The reinforcement in each of these side walls comprises a rigid channel-section length 18 having a stiff mesh, which is made from heat-resisting alloy, recrystallized alumina or a refractory clay, extending along the side wall but in this instance terminating short of the corners of the block which are naturally stronger than the middle portions of the side wall. The width dimension of the web 19 of the channel extends in an inward and outward direction whilst the two flanges 20, 21 of the channel extend in a direction through the thickness of the side wall, flange 21 of the channel being disposed at the rear edge of the side wall since this flange 21 is used in securing the reinforcement channel 18 in the mould during manufacture of the component. As shown in FIG. 2, the mesh is of diamond or lozenge form and the reinforcement is so cut and disposed that each of the lengths of material defining the mesh apertures of inclined with respect to the inward and outward direction. In order to avoid the formation of voids in the region of the reinforcement during the moulding process and to bind the reinforcement securely into the fibre, the fibre strands should extend through the apertures and then fill them and for this reason it is preferable to use mesh with fairly large apertures; the longer the fibres the larger the apertures should be. The teeth of the fasteners preferably extend just outside the channel but close to the inner flange 20 of the channel, but may where the teeth are of a small and compact cross-section extend through apertures in the web of the channel.

The above-mentioned inclination of the lengths of refractory material defining the apertures ensures that substantially all of the material of the channel serves to spread what would otherwise be point compression loads exerted by the teeth over the greater part of the fabric of the wall.

The reinforcing members may be made from refractory clay or similar cheaper refractory materials if the furnace operating conditions permit.

Instead of the channel section shown in FIGS. 1 to 3, the reinforcement may be of T-section as shown in FIG. 5, the leg 25 of the T extending at right angles to the bounding wall of the furnace chamber from the rear or cold edge of the side wall, and the cross-piece 26 extending parallel to said bounding wall. Alternatively the reinforcement may be of L-section as shown in FIG. 6, the foot 27 of the section extending at right angles to the bounding wall of the chamber from the rear or cold face of the side wall, and the leg 28 of the section extending through the thickness of the side wall, i.e., parallel to the bounding wall of the furnace.

It will be understood that the same method of reinforcement can be used for wall modules and other components for a furnace which components are made from fibre by a vacuum moulding technique and are secured to the furnace casing by the same general type of fastener as is described above and as is illustrated in our Patent Specfication No. 1544407.

It will be seen that the invention also provides a furnace component vacuum-formed from refractory fibre and having formed integrally therewith a support portion by which the component is to be supported from the exterior of a furnace, which support portion has embedded therein a reinforcing member of stiff open-mesh form and made from heat-resistant metal alloy or a refractory material, e.g. re-crystallized alumina or refractory clay, said member comprising a first part extending along said support portion from a position spaced outwardly from the "hot" or inner end or face of the component to a position adjacent the "cold" or outer end or face of said support portion, and a second part rigidly connected to and extending transversely of the first part at a location spaced from both the hot and cold ends or faces of the components.

Thus when the component is mounted on the casing, the said first part of the reinforcing member extends along the support portion towards the casing, and the said second part extends in the direction of the thickness of the support portion and, preferably, generally parallel to the adjacent part of the inner surface of the furnace.

The term "wall" used herein in relation to a furnace is intended to include the roof and floor of the furnace in addition to the side wall thereof.

We claim:

1. A refractory component vacuum formed from ceramic fiber to be mounted on an exterior structure which defines the general outline of a furnace chamber, said component forming part of a refractory wall of the furnace chamber and having embedded therein during the vacuum forming process one or more reinforcing members of stiff open-mesh form disposed in that region of the component which will eventually be placed nearest to said structure and from which region the component is to be anchored to the structure, the reinforcing member being made of heat resisting metal alloy, refractory clay or re-crystallized alumina and at least part of said open mesh being arranged to extend generally parallel to the local portion of the wall of the chamber.

2. A refractory component as claimed in claim 1, wherein each of the open-mesh reinforcing members is of three dimensional form.

3. A reinforcing component as claimed in claim 2, and wherein the component has two faces facing in mutually opposite directions away from each other and constituting a hot face and a cold face respectively, and one or more side walls extending between said hot and cold faces, wherein the reinforcing member or members are disposed in said side wall or side walls and are of channel-section, the two side flanges of the channel extending parallel to the cold face of the component and constituting said part extending parallel to the local portion of the wall of the chamber.

4. A refractory component as claimed in claim 3, wherein one of said side flanges is disposed substantially in the cold face of the component.

5. A refractory component as claimed in claim 2, and wherein the component has two faces facing in mutually opposite directions away from each other and constituting a hot face and a cold face respectively and a portion which extends between the hot and cold faces and which provides said region wherein the reinforcing member or members are of T-section, the foot of the section being disposed substantially in the cold face of the component and the cross-piece of the section constituting said part and extending parallel to the cold face of the component.

6. A refractory component as claimed in claim 2, and wherein the component has two faces facing in mutually opposite directions away from each other and constituting a hot face and a cold face respectively and a portion which extends between the hot and cold faces and which provides said region wherein the reinforcing member or members are of an L-shape section, one of the two webs of the section extending substantially in the plane of the cold face of the component, and the other of the webs projecting away from said cold face, having its free edge substantially in the colder face of the component.

7. A refractory component as claimed in claim 1, wherein the reinforcing member or members are of diamond or oval mesh.

8. A refractory component as claimed in claim 1, wherein the component is in the form of a hollow rectangular box which is open at one face, which constitutes the cold face, and has a front wall providing a hot face and four rearwardly-extending side walls which terminate at the cold face, each of said side walls having embedded therein a reinforcing member as aforesaid which is of diamond mesh and of rectangular channel section, one side flange of the channel being disposed substantially in the plane of the cold face, the other side flange of the channel extending parallel to the cold face, and the web of the channel being disposed substantially centrally of the thickness of said side wall.

9. A refractory component vacuum formed from ceramic fiber to be mounted on an exterior structure which defines the general outline of a furnace chamber, said component forming part of a refractory wall of the furnace chamber and having embedded therein during the vacuum forming process one or more reinforcing members of stiff open-mesh form disposed in that region of the component which will eventually be placed nearest to said structure and from which region the component is to be anchored to the structure, the reinforcing member being made of heat resisting metal alloy, refractory clay or re-crystallized alumina and said reinforcing member having parts thereof extending respectively parallel to and at right angles to the local portion of the wall of the chamber.

10. A refractory component vacuum formed from ceramic fiber and having a hot face, a cold face, and side surfaces extending between the hot and cold faces, and said component having incorporated therein during the vacuum-forming process at least one reinforcing member of stiff open-mesh form spaced from said hot face and disposed adjacent a side surface of the component, said reinforcing member being made from a heat resisting alloy, refractory clay or re-crystallized alumina and comprising a first portion extending parallel to said hot face and spaced from said hot face and a second portion extending from the first portion towards the cold face.

11. A refractory component as claimed in claim 10, wherein the reinforcing member is of an L-shape section, one limb of which constitutes said first portion and the other limb of which constitutes said second portion.

12. A refractory component as claimed in claim 10, wherein the reinforcing member is of T-section, the leg of which constitutes the second member and the cross-piece of which constitutes the first member.

13. A furnace structure comprising an external supporting structure and a plurality of refractory components, which are secured to and securing means whereby said components are secured to the supporting structure and define a furnace chamber, each of said refractory components being vacuum formed from ceramic fiber and having a hot face, a cold face, and side surfaces extending between the hot and cold faces, and said component having incorporated therein during the vacuum-forming process at least one reinforcing member of stiff open-mesh form spaced from said hot face and disposed adjacent a side surface of the component, said reinforcing member being made from a heat resisting alloy, refractory clay or re-crystallized alumina and comprising a first portion extending parallel to said hot face and spaced from said hot face and a second portion extending from the first portion towards the cold face and the external supporting structure, and said securing means comprising a plurality of anchor members, each of which comprises an outer end portion secured to the supporting structure, a leg portion connected to said outer end porton and extending towards the furnace chamber between two of said refractory components, which two components adjoin each other, and laterally projecting teeth which are connected to the leg portion and which are pressed into side surfaces of said two components adjacent said first portion of a said reinforcing member disposed adjacent such side surface of each of the two said components.

* * * * *